US007712626B2

(12) United States Patent
Vovan

(10) Patent No.: US 7,712,626 B2
(45) **Date of Patent: *May 11, 2010**

(54) EDGE-TEARING TAMPER EVIDENT CONTAINER

(75) Inventor: Terry Vovan, Upland, CA (US)

(73) Assignee: PWP Industries, Vernon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/512,817

(22) Filed: Jul. 30, 2009

(65) Prior Publication Data

US 2009/0321463 A1 Dec. 31, 2009

Related U.S. Application Data

(63) Continuation of application No. 11/496,215, filed on Jul. 31, 2006, now Pat. No. 7,568,589, which is a continuation-in-part of application No. 11/166,308, filed on Jun. 24, 2005, now abandoned.

(51) Int. Cl.
*B65D 41/32* (2006.01)

(52) U.S. Cl. ..... 220/791; 220/4.23; 220/266; 220/377; 220/789

(58) Field of Classification Search ..... 220/4.23, 220/266, 276, 377, 789, 791, 793, 835, 839, 220/849; 426/394
See application file for complete search history.

(56) References Cited

U.S. PATENT DOCUMENTS

| | | | |
|---|---|---|---|
| 3,773,207 | A | 11/1973 | Dokoupil et al. |
| 4,006,839 | A | 2/1977 | Thiel et al. |
| 4,091,930 | A | 5/1978 | Buchner et al. |
| 4,433,793 | A | 2/1984 | Ingemann |
| 4,535,889 | A | 8/1985 | Terauds |
| 4,759,463 | A | 7/1988 | Mazoin |

(Continued)

FOREIGN PATENT DOCUMENTS

| | | |
|---|---|---|
| DE | 7816353 | 11/1978 |

(Continued)

OTHER PUBLICATIONS

*Food container* purportedly published in Apr. 2005.

(Continued)

*Primary Examiner*—Anthony Stashick
*Assistant Examiner*—Elizabeth Volz
(74) *Attorney, Agent, or Firm*—Knobbe, Martens, Olson & Bear LLP

(57) ABSTRACT

A food container formed from plastic, can be loaded with food and then closed by a clerk, and thereafter cannot be opened without tearing apart first sides (24, 26) of the base (12) and lid (16). The container is formed by a single sheet of plastic that forms a base and lid with second sides (20, 22) that are latched together and with adjacent first sides that are joined by a joint line (30) in the plastic that is creased and that has slits (40). At the joint line, the lid has a projecting lid tab (32) and the base has a projecting base tab (36). A person grasps both tabs, and lifts only the lid tab to tear apart the first sides of the base and lid along the joint line (30). Thereafter, the lid can be easily closed and reopened on the base.

13 Claims, 6 Drawing Sheets

U.S. PATENT DOCUMENTS

| | | | |
|---|---|---|---|
| 4,765,463 | A | 8/1988 | Chanel |
| 4,881,656 | A | 11/1989 | Chumley et al. |
| 4,890,758 | A | 1/1990 | Gailus |
| 4,930,656 | A | 6/1990 | Blanchette |
| 4,966,292 | A | 10/1990 | Marino |
| 4,998,622 | A | 3/1991 | Drack |
| 5,002,198 | A | 3/1991 | Smith |
| 5,027,969 | A | 7/1991 | Lesquir |
| 5,040,695 | A | 8/1991 | Adams et al. |
| 5,052,574 | A | 10/1991 | McKinnon et al. |
| 5,111,953 | A | 5/1992 | Faust et al. |
| 5,111,954 | A | 5/1992 | Gaudreault |
| 5,115,934 | A | 5/1992 | Nelson |
| 5,129,531 | A | 7/1992 | Beck et al. |
| 5,170,905 | A | 12/1992 | Luch |
| 5,219,074 | A | 6/1993 | Mizuno et al. |
| 5,219,087 | A | 6/1993 | Christensson |
| 5,249,694 | A | 10/1993 | Nelson |
| 5,287,959 | A | 2/1994 | Hansen et al. |
| 5,307,948 | A | 5/1994 | Blackburn et al. |
| D352,000 | S | 11/1994 | Hansen et al. |
| 5,421,473 | A | 6/1995 | McCrossen |
| 5,507,405 | A | 4/1996 | Thomas et al. |
| 5,507,406 | A | 4/1996 | Urciuoli et al. |
| 5,511,679 | A | 4/1996 | Beck |
| 5,528,814 | A | 6/1996 | Luch et al. |
| 5,545,375 | A | 8/1996 | Tropsha et al. |
| 5,573,134 | A | 11/1996 | Chenault et al. |
| 5,607,075 | A | 3/1997 | Burgdorf et al. |
| 5,683,771 | A | 11/1997 | Tropsha |
| 5,842,593 | A | 12/1998 | von Holdt |
| 5,875,913 | A | 3/1999 | Letica |
| 5,897,011 | A | 4/1999 | Brilliant et al. |
| 5,931,332 | A | 8/1999 | Mygatt et al. |
| 5,979,690 | A | 11/1999 | Hartley |
| 6,000,570 | A | 12/1999 | Nelson |
| RE36,729 | E | 6/2000 | Luch et al. |
| 6,116,501 | A | 9/2000 | Hupp |
| 6,135,304 | A | 10/2000 | Wyslotsky |
| 6,168,044 | B1 | 1/2001 | Zettle et al. |
| 6,257,435 | B1 | 7/2001 | Chedister et al. |
| 6,279,774 | B1 | 8/2001 | Clute et al. |
| 6,564,958 | B1 | 5/2003 | Ramsey et al. |
| 6,572,909 | B1 | 6/2003 | Bagwell et al. |
| 6,604,645 | B1 | 8/2003 | Vaupotic |
| 6,772,901 | B2 | 8/2004 | Witt |
| 6,926,165 | B2 | 8/2005 | Conti |
| 7,004,341 | B2 | 2/2006 | Shenkar et al. |
| 7,073,680 | B2 | 7/2006 | Boback et al. |
| 7,097,058 | B2 | 8/2006 | Wellman et al. |
| 7,118,003 | B2 | 10/2006 | Sellari et al. |
| 7,207,457 | B2 | 4/2007 | Schwarz |
| 7,243,813 | B2 | 7/2007 | Krueger |
| 7,311,218 | B2 | 12/2007 | Varadarajan |
| 2003/0052133 | A1 | 3/2003 | Hayes et al. |
| 2003/0160051 | A1 | 8/2003 | Ciccone |
| 2004/0134910 | A1 | 7/2004 | Colombo |
| 2006/0060578 | A1 | 3/2006 | Church et al. |
| 2006/0163265 | A1 | 7/2006 | De Candido |
| 2006/0201946 | A1 | 9/2006 | Witt |
| 2006/0255054 | A1 | 11/2006 | Vovan |
| 2006/0261070 | A1 | 11/2006 | Robertson et al. |
| 2006/0266750 | A1 | 11/2006 | Lesquir |
| 2006/0278652 | A1 | 12/2006 | Vovan et al. |
| 2006/0289549 | A1 | 12/2006 | Vovan |
| 2007/0012710 | A1 | 1/2007 | Vovan |
| 2007/0062948 | A1 | 3/2007 | Albrecht et al. |
| 2007/0108210 | A1 | 5/2007 | Alvares et al. |
| 2007/0138046 | A1 | 6/2007 | Vovan |
| 2007/0138180 | A1 | 6/2007 | Vovan |
| 2007/0196541 | A1 | 8/2007 | Vovan et al. |
| 2008/0000904 | A1 | 1/2008 | Vovan |
| 2008/0006632 | A1 | 1/2008 | Vovan |
| 2008/0185383 | A1 | 8/2008 | Philippe et al. |
| 2009/0021026 | A1 | 1/2009 | Collier |
| 2009/0057313 | A1 | 3/2009 | Alvares |
| 2009/0206082 | A1 | 8/2009 | Vovan |

FOREIGN PATENT DOCUMENTS

| | | |
|---|---|---|
| DE | 4418935 | 12/1995 |
| DE | 1999083197 | 8/1999 |
| EP | 0752374 | 1/1997 |
| GB | 2257118 | 1/1993 |

OTHER PUBLICATIONS

*Safer Sandwiches*, www.packagingtoday.co.uk—Packaging Today, purportedly published in Apr. 2005.

*Tamper Evident Container*, dated Sep. 13, 2004 and purportedly exhibited in a foreign country in Apr. 2005.

*Tri-Star to Unveil First Ever Tamper Evident Salad Containers at Total Sandwich Show*, Sandwich and Snack News, purportedly published in Apr. 2005.

U.S. Appl. No. 12/200,670, filed Aug. 28, 2008, Inventor Vovan, Title "Tamper-Evident Food Packaging".

U.S. Appl. No. 12/371,888, filed Feb. 16, 2009, Inventor Vovan, Title "Hangable Tamper Resistant Packaging System".

EDGE-TEARING TAMPER EVIDENT CONTAINER

CROSS-REFERENCE TO RELATED APPLICATIONS

This is a continuation application of U.S. patent application Ser. No. 11/496,215, filed 31 Jul. 2006, which is a continuation-in-part of U.S. patent application Ser. No. 11/166,308, filed 24 Jun. 2005, each of which are incorporated by reference herein in their entireties.

BACKGROUND OF THE INVENTION

1. Field of the Invention

The invention generally relates to containers, and in particular to tamper-evident containers.

2. Description of the Related Art

Food is often placed in a transparent plastic container that includes a base with a large volume cavity that holds the food and with a cover or lid that closes the cavity. Buyers want to be assured that, after the food was placed in the container as by a clerk at the food store, that the container has not been opened. There is a possibility that another customer has secretly opened the container enough to taste a bit of food before closing it (and possibly leaving germs from his/her finger in the food). Potential buyers want to be assured that this has not happened. A container that could be constructed at low cost from plastic, that could be easily initially closed by a clerk at a store after loading goods such as food into the container, and which thereafter required a customer to tear apart parts of the container before initially opening it, would be of value.

SUMMARY OF THE INVENTION

In accordance with one embodiment of the invention, a container is provided that can be constructed at low cost, that can be loaded with goods and initially closed by a clerk at a store, and that thereafter requires a customer to manipulate the container when initially opening it, in a manner that makes it clear that the container was initially opened. The container is constructed of plastic, and preferably of a sheet of plastic that has been formed into the shape of a base having an upwardly-opening cavity for holding goods, and a lid that can close the cavity. The base and lid initially have adjacent first sides and widely-spaced second sides. The first sides are joined by a join line in the plastic sheet that can be easily torn. At the join line, the base and lid have been bent and the bend has been creased, so rim portions of the base and lid lie facewise adjacent to each other. A bump is formed in one of the rim portions to slightly separate the base and lid rim portions.

A clerk loads food into the cavity of the base, and moves the second sides of the container together so they latch together. The second sides latch together to close the container, in a manner that prevents their initial separation. With the second sides of the base and lid latched together and the first sides joined along a join line that must be torn to separate the first sides, the container is securely initially closed. In this condition, the goods in the container cannot be readily touched or sampled by a customer. For a buyer of the container to initially open the container, the buyer must tear apart the first sides of the base and lid along the join line. The join line is weakened, as by a series of slits, so it can be more easily torn apart.

The first sides of the base and lid are formed with a tab in the lid that can be pulled up to tear the join line while the base is held down. The base can be held down by a person grasping a base tab that is horizontally spaced from the lid tab. The outer end of the lid tab, which lies furthest from the container vertical axis, is formed out of material in a flat rim of the first side of the base, to thereby leave a cutout in the base under the lid tab.

The novel features of the invention are set forth with particularity in the appended claims. The invention will be best understood from the following description when read in conjunction with the accompanying drawings.

DETAILED DESCRIPTION OF THE PREFERRED EMBODIMENT

Figure 1:
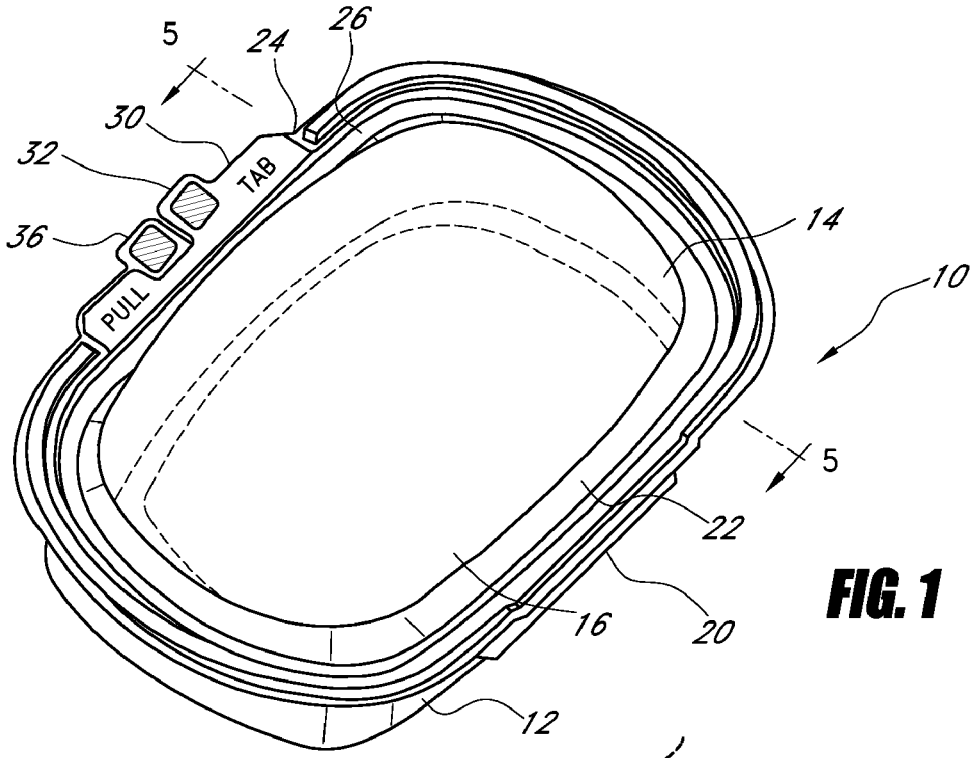
FIG. 1 is a top and rear isometric view of a container of a first embodiment of the invention in its initially closed position.
Figure 2:
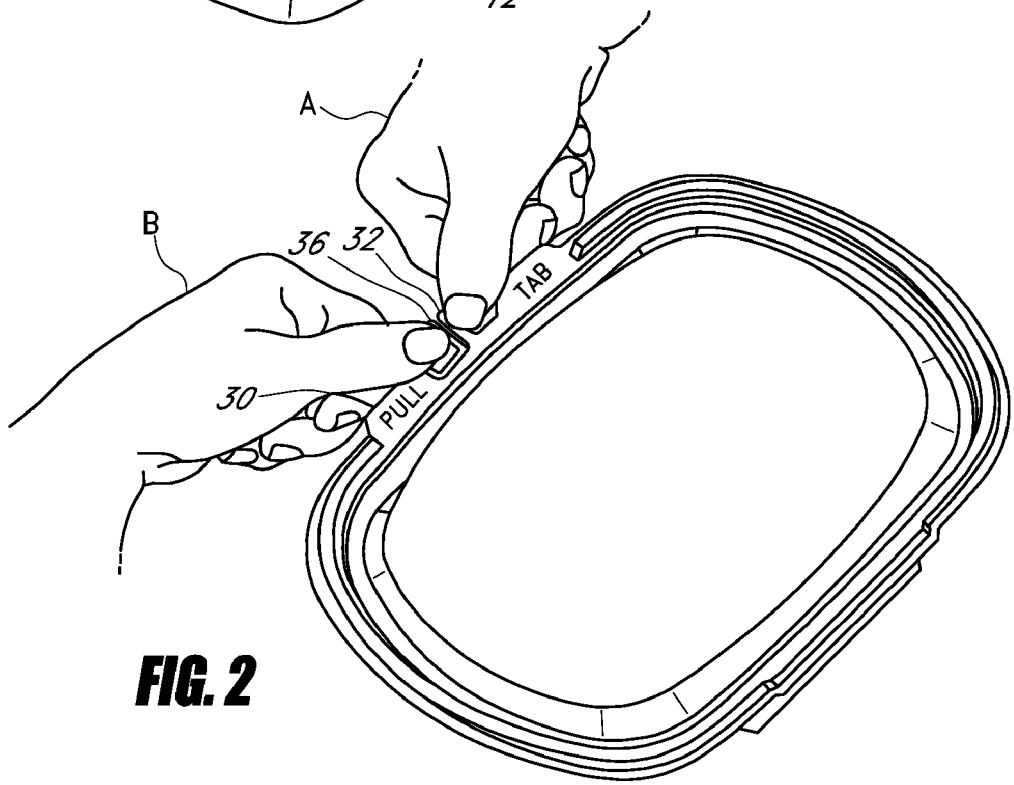
FIG. 2 is a view similar to that of FIG. 1, but showing a person initially opening the container.

FIG. 1 illustrates a container 10 of the present invention, which includes a base 12 with an upwardly-opening cavity 14 for holding goods such as food, and a lid 16 that closes the top of the cavity. The base and lid of FIG. 1 are preferably formed of a single sheet of plastic that has been thermoformed as by vacuum forming, transfer molding or blow molding. It is even possible to injection mold the container to form a container comprising a plastic sheet. The base and lid have second sides 20, 22 that are securely held to each other so the second sides cannot be separated until after first sides 24, 26 have been separated. The first sides 24, 26 of the base and lid are initially fixed together along a join line 30 formed in an integral portion of the plastic sheet, that can be easily torn. Along the first sides, the lid has a lid tab 32 that projects radially outward with respect to the container vertical axis 34 and the base has a projecting base tab 36. As shown in FIG. 2, the container can be initially opened by a person grasping the lid tab 32 between the thumb and index fingers of a first hand A and lifting the lid tab. At the same time, the person can hold down the base by grasping the base tab 36 between the thumb and index fingers of the person's other hand B. Such lifting causes the lid and base to tear apart along the join line 30. The join line can be straight or curved or jagged.

Figure 3:
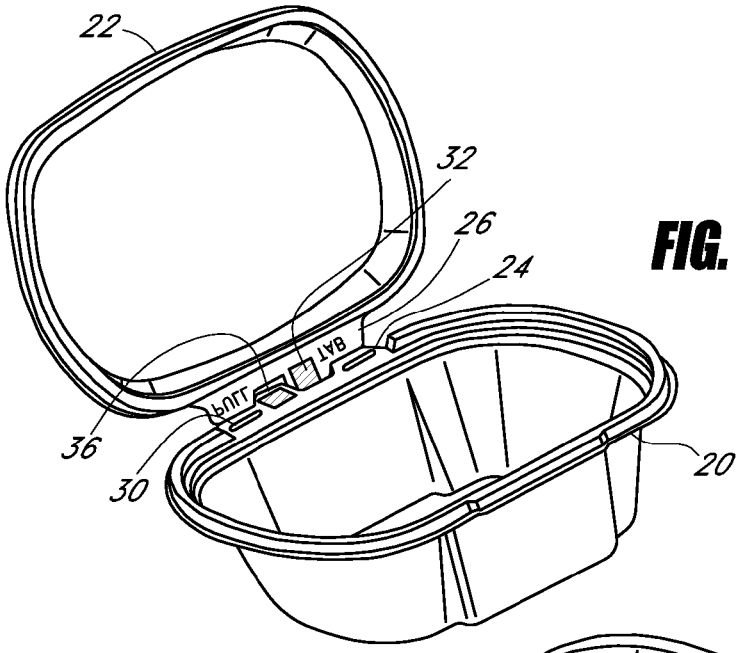
FIG. 3 is a top and rear isometric view of the container of FIG. 1, showing the container prior to its initial closing, and with the lid raised.
Figure 4:
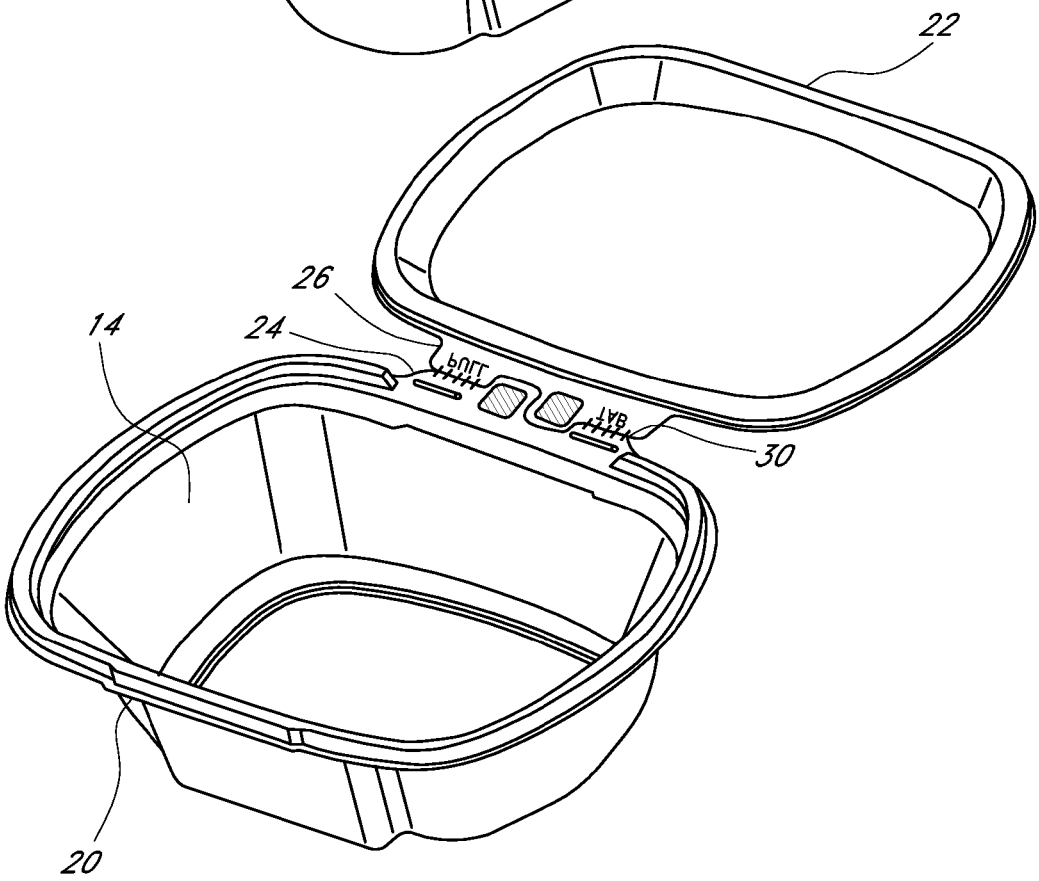
FIG. 4 is top and rear isometric view of the container of FIG. 3, with the lid in its fully open position prior to its initial closing, and showing the container as its is initially vacuum formed.

FIGS. 3 and 4 show the container 10 as it is supplied to a store, and before a store clerk has loaded goods into the container and initially closed the container. The first sides 24, 26 of the base and lid are joined along the join line 30, but the second sides 20, 22 are separated. The base and lid are in the form of thin plastic or plastic sheeting, and preferably are parts of the same sheet of plastic (which may have portions of different thickness). The join line is formed in an integral sheet of plastic. FIG. 4 shows the container as it is initially formed from a single sheet of thermoformed plastic which has been thermoformed to the illustrated shape, and with slits cut along the join line 30. The lid is folded or bent 180 degrees from FIG. 4 to achieve the initially closed position of FIGS. 1 and 2.

Figure 6:
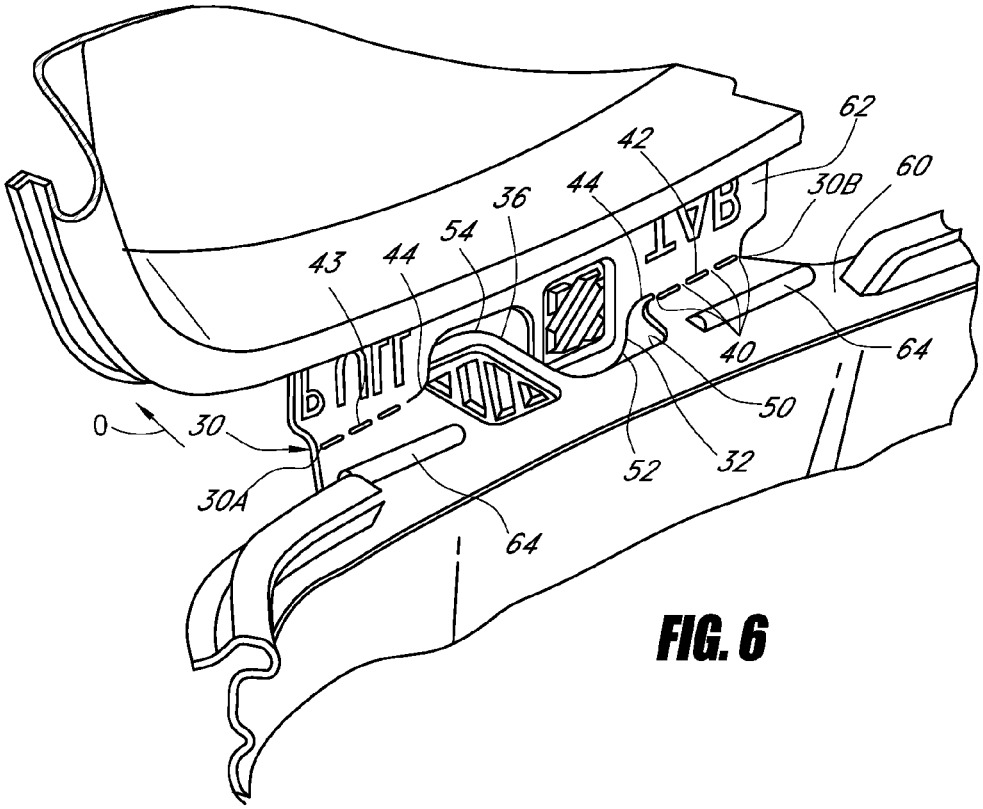
FIG. 6 is an enlarged isometric view of a portion of the container of FIG. 3.

FIG. 6 shows the first sides of the base and lid, showing that the join line 30 includes opposite join line parts 30A and 30B that lie on opposite sides of the lid and base tabs 32, 36. Along each join line part there are four join lengths 40 and an interrupted slit 42 with slit parts 43. Applicant prefers to provide join lengths 40 each of no more than 0.25 inch length. Leading to each join line part 30A, 30B is an entrance slit 44 of an end width of the same order of magnitude as the slit 42, that leads from the tabs 32, 36 to the join line parts, to concentrate separation forces along the join line parts. In addition, the plastic sheet has been creased (by forming a sharp bend such as a bend having a radius of curvature no more than the thickness of the two sheet portions being bent) to weaken it along the join line.

It can be seen in FIG. 6 that the lid tab 32 has a radially outward O extension 52 that projects beyond the join line 30, and that the base has a cutout 50 initially lying around the lid extension (when the lid is pivoted 180 degrees from its closed position). The base tab 36 has a similar extension 54 and the lid forms a cutout around it. This provides longer tabs that can be more easily grasped and cutouts under or over the tabs. FIG. 6 also shows that the first sides of the base and lid form join rim parts 60, 62 that are each flat and that lie facewise adjacent to each other when the lid is closed on the base. The rim part 60 of the base has bumps 64 that assure slight separation of the rim portions after the join line is torn.

A clerk at a store receives a stack of containers in the configuration shown in FIG. 4, with the first sides 24, 26 of the base and lid joined and with the second sides 20, 22 widely separated. The clerk first loads goods such as food into the cavity 14 of the base, and then pivots the lid so its second side lies over the base second side. The clerk then forces the lid second side downward to lock, or latch it to the base second side, to place the container in an initially closed configuration. FIGS. 1 and 2 show the container in such initially closed configuration.

Figure 5:
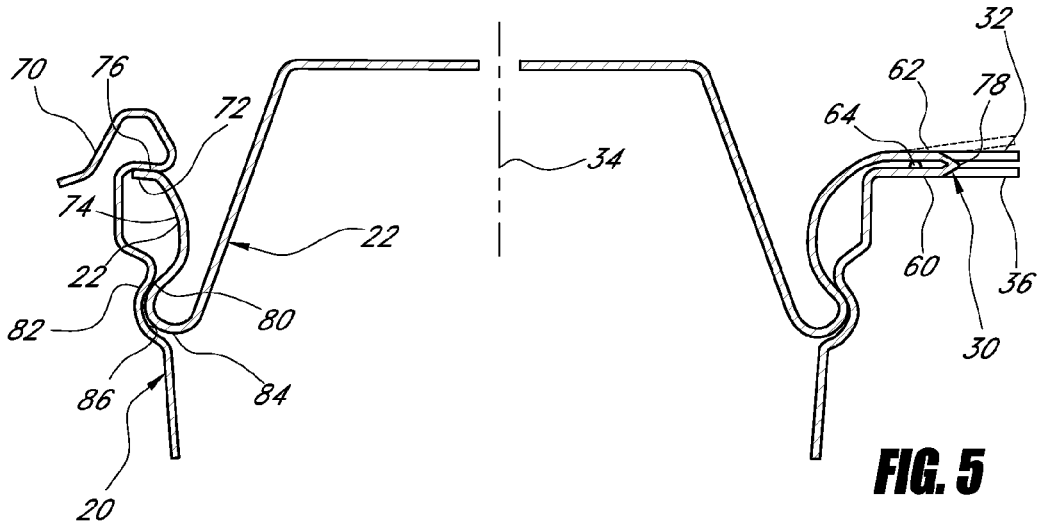
FIG. 5 is a sectional view taken on line 5-5 of FIG. 1.

FIG. 5 shows the first and second sides of the base and lid after the lid has been initially closed on the base. The second side 20 of the base has a free rim 70 with a downwardly-facing shoulder 72, and the second side 22 of the lid has a free rim 74 with an upwardly-facing shoulder 76 that abuts the base shoulder 72 to latch the container second side closed. The base and rim also have sealing surfaces 80, 82 that abut to prevent the leakage of liquids and that keep the lid closed after the initial opening but allow opening with a small force such as less than one pound. When the clerk presses down the lid on the base during initial closing of the container, the lid moves down until stopped by a lid limit surface 84 abutting the base limit surface 86, and the lid moves up slightly to its final closed position shown in FIG. 5. In that position, the shoulder 76 on the lid free rim 74 abuts the base shoulder 72 to thereafter prevent the lid second side from being lifted while allowing the lid to be pivoted. The same lid and base sealing surfaces and shoulders extend around the entire container, except that the shoulders 72, 76 are not present below the portion of the first side of the base and lid that lies below the join line and the tabs.

It would be possible to fix the second sides of the lid and base to each other in a true pivot joint, as by sonically welding the top and bottom of a strip of flexible sheet plastic material to the base and lid, although that is not necessary. FIG. 5 shows that the flat rim parts 60, 62 that lie along the joining line 30, lie facewise adjacent to each other with only the bumps 64 separating them, and also shows the crease line 78.

There are no tabs or other projections at the lid second side 20 that can be grasped to pull it up. Accordingly, after the clerk has initially closed the lid on the base, the only way for a customer to open the container is for the customer to tear the plastic sheet along the join line 30, as by forcefully lifting the lid tab 32 while holding down the base (as by holding the base tab 36). When the customer tears the plastic sheet along the join line, he/she thereafter can easily close the container, and can reopen the container by lifting the lift tab 32 with a small force (e.g. less than one pound). When the first side of the container is opened by lifting the lid tab 32, the second side of the lid can slide slightly towards the first side so the lid shoulder 74 does not lie under the base shoulder and therefore the lid can be easily completely separated from the base.

Figure 7:
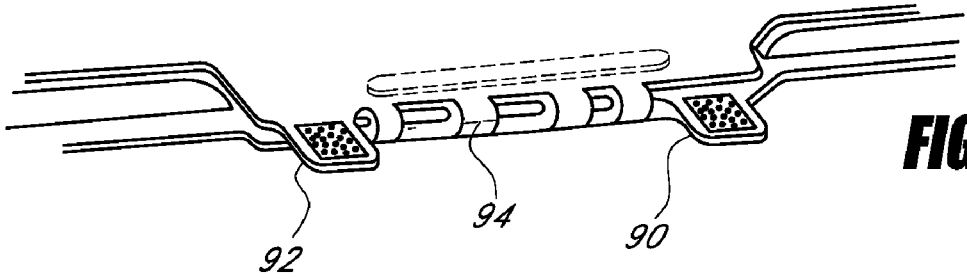
FIG. 7 a partial isometric view of a first side of a container of another embodiment of the invention, wherein base and lid tabs lie on opposite sides of a join line, with the container in its initially closed position.
Figure 8:
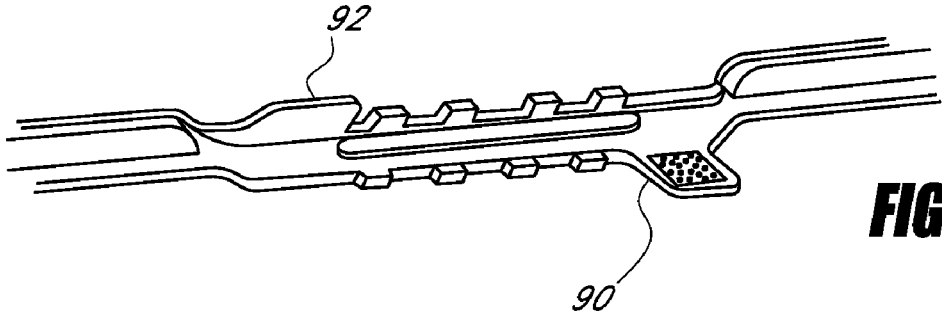
FIG. 8 is a view similar to that of FIG. 7, but with the container in the configuration it achieves after an initial opening.
Figure 9:
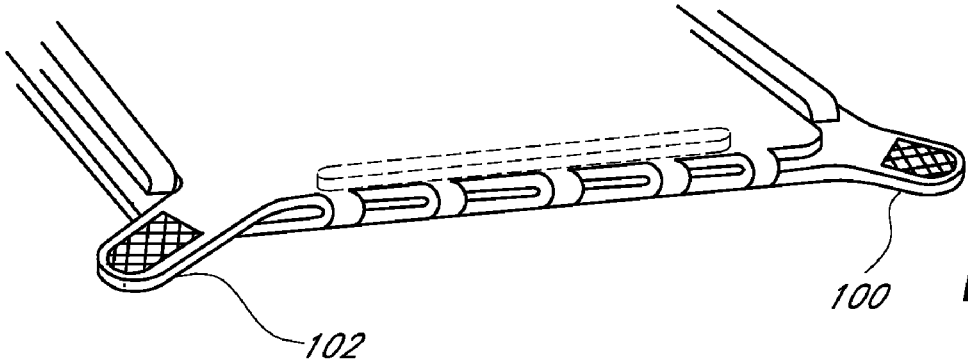
FIG. 9 is a partial isometric view of a first side of a container of another embodiment of the invention, wherein the base and lid tabs lie at opposite corners of the first side of the container, with the container in its initially closed position.
Figure 10:
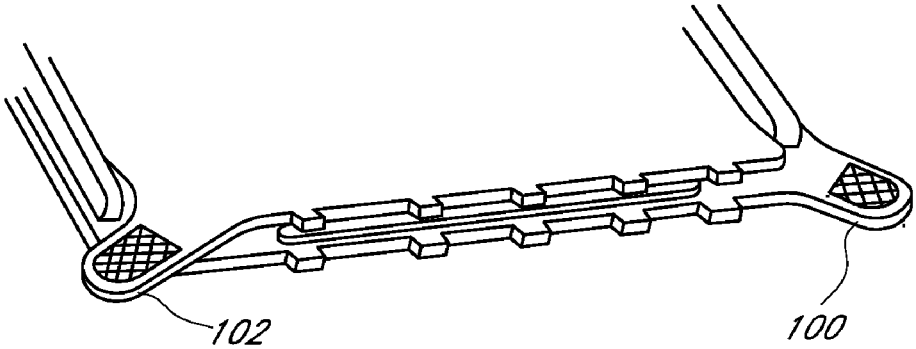
FIG. 10 is a view similar to that of FIG. 9, but with the container in the configuration it achieves after an initial opening.

FIG. 7 shows another embodiment of the invention wherein the base and lid tabs 90, 92 lie on opposite sides of an uninterrupted join line 94. In FIG. 7 the join line 94 has not been torn, while FIG. 8 shows the join line torn as a result of an initial opening of the container. FIGS. 5 and 10, show another embodiment of the invention wherein the base and lid tabs 100, 102 lie at corners of a container of rectangular shape (as seen in a plan view), at opposite ends of the first side of the container.

Figure 13:
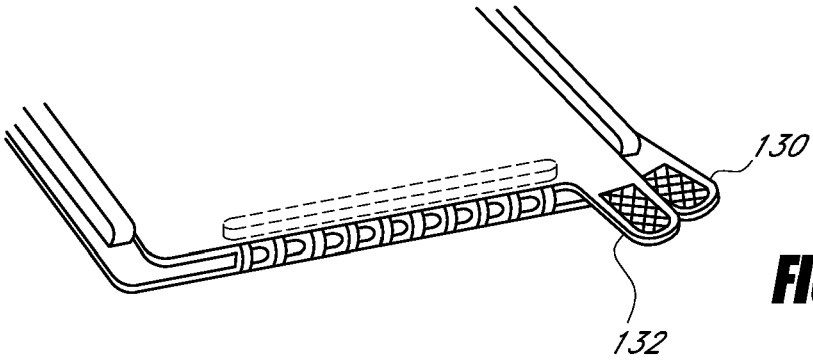
FIG. 13 is a partial isometric view of a container of another embodiment of the invention which is similar to FIG. 9, but with the base and lid tabs at the same corner of the container.
Figure 14:
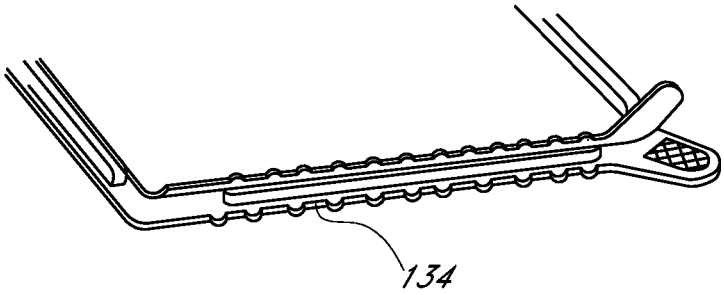
FIG. 14 is a view similar to FIG. 13 after an initial container opening.
Figure 15:
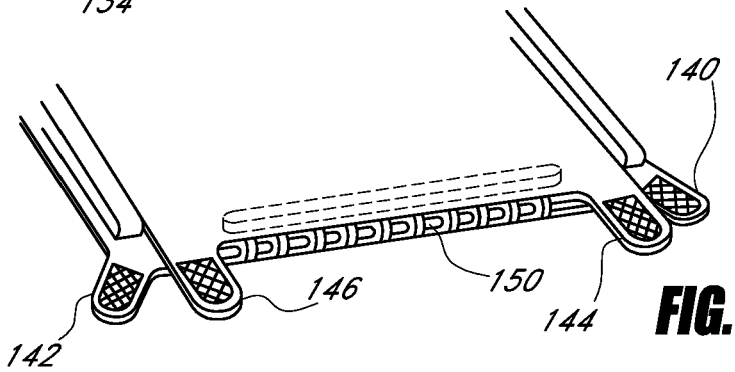
FIG. 15 is a view of a container similar to that of FIG. 13 but with base and lid tabs at each of two corners.
Figure 16:
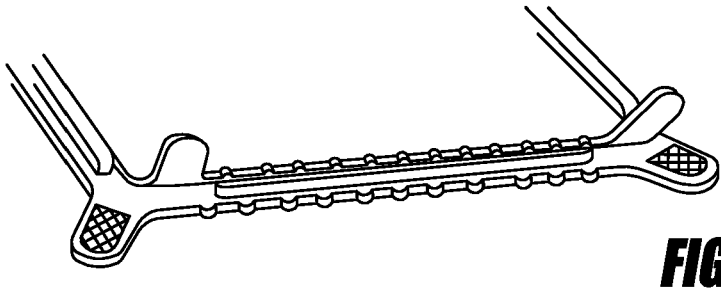
FIG. 16 is a view similar to that of FIG. 14, after an initial container opening.

FIG. 13 shows another container wherein the base and lid tabs 130, 132 lie one above the other, and at a corner of a container. In FIG. 14 the join line 134 has been torn as a result of an initial opening, and the lid tab has been bent to extend at an upward incline. FIG. 15 shows a pair of base and lid tabs 140, 142, 144,146 at opposite ends of a join line 150. FIG. 16 shows the container of FIG. 15 after the lid tabs have been pulled up and the join line has been torn.

Figure 11:
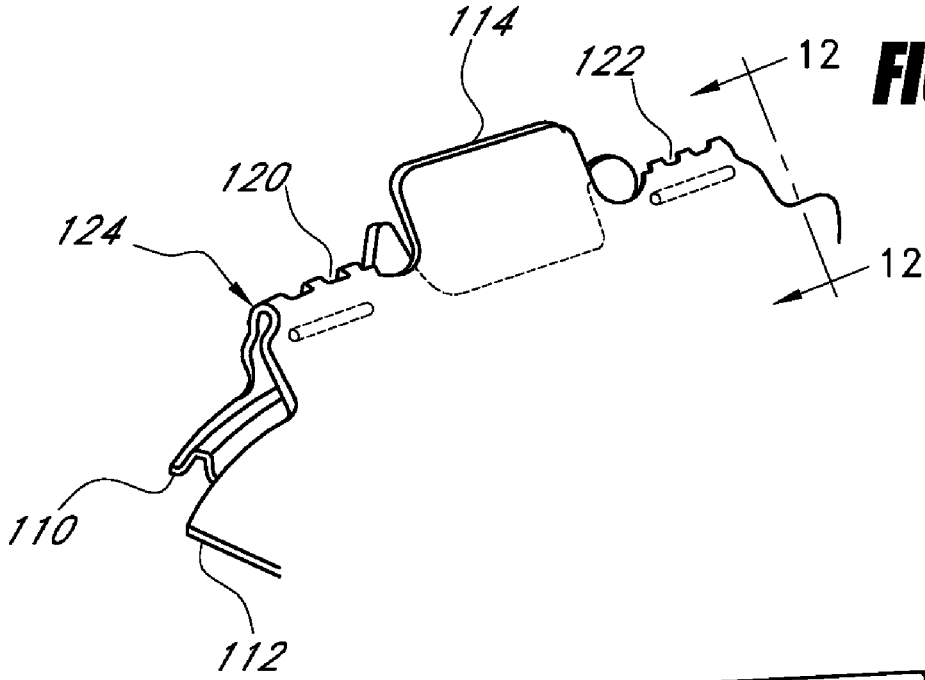
FIG. 11 is a partial isometric view of a container of another embodiment of the invention, which has a lid tab but no base tab.
Figure 12:
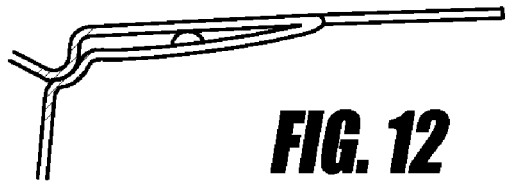
FIG. 12 is a sectional view taken on line 12-12 of FIG. 11.

FIG. 11 shows a portion of a base 110 and lid 112 of a round (of circular or oval configuration as seen in a plan view) container, with only a lid tab 114 between opposite portion 120, 122 of a join line 124. A person grasps the base with one hand while lifting the lid tab 114 with the other hand to tear the join line to initially open the container (that is, to first open the container after it was initially closed).

The container can be formed from a wide variety of polymers, including polystyrene, polypropylene, polyethylene terephthate, etc. Instead of a container of primarily rectangular shape as illustrated in a plan view, the container may be circular, elliptical, or of any reasonable polygonal shape. The base (and cover) can have walls forming compartments, and the container can include a middle tray.

Thus, the invention provides a container comprising a base and lid that can be constructed at low cost, that can be shipped to a store with its cavity open to enable easy loading of food or other goods by a store clerk, and that can be easily closed by the store clerk. The base and lid are preferably formed of a single sheet of plastic, and are joined by a join line that can be torn. After initial closing by the store clerk, the container strongly resists initial opening, to greatly discourage customers from secretly opening the container as to taste food in it. Instead, initial opening requires forceful opening by lifting a tab on the lid to tear the plastic sheet along the join line. Once the container has been initially opened, the fact that it has been initially opened is evident to anyone who looks at the container, which assures buyers that the container is intact. The container thereafter can be easily opened and closed. The plastic sheet that forms the container has a crease along the tear line, and has a narrow slit leading to the tear line. The lid tab extends axially outward beyond the join line by leaving a cutout when it is formed in the plastic sheet.

Although particular embodiments of the invention have been described and illustrated herein, it is recognized that modifications and variations may readily occur to those skilled in the art, and consequently, it is intended that the claims be interpreted to cover such modifications and equivalents.

The invention claimed is:

1. A container comprising a base and lid of plastic, the base and lid each having first and second sides and the second sides of the base and lid are latched together to inhibit initial opening thereat, said container forming an arrangement at said first side of the base and lid that requires an additional lift force on the lid to initially separate the lid first side from the base first side, but after the initial separation followed by closing of the lid it requires a lesser lift force to separate the lid first side from the base first side, wherein:

at said first side, said lid and base are joined by a join line in an integral portion of said plastic, with said join line being weakened to be less resistant to tearing along said join line than along the rest of the plastic sheeting, to facilitate tearing at said join line;

at said first side of said lid and base, said base has a projection extending radially outward from a gap in said join line that can be grasped, to lift said base first side with sufficient force to tear apart said lid and base along said join line and to lift said base first side with sufficient force to separate said lid first side from said base first side.

2. The container described in claim 1 wherein: said base and lid are formed of a single sheet of plastic, and along said join line, said lid and base are joined by integral portions of the plastic sheet.

3. The container described in claim 1 wherein: said base second side has a downwardly-facing base shoulder and said lid second side has an upwardly-facing lid rim part that lies under said base shoulder, to prevent said lid second side from lifting unless said lid first side has been lifted off said base first side so said lid second side can be slid so it does not lie under said base shoulder.

4. The container described in claim 1 wherein: said join line does not separate the projection from the remainder of the base.

5. The container described in claim 1 wherein: said base and lid each have adjacent flat rims lying beside said join line, and of the flat rims of said base and lid at least one of them has a bump that projects towards the other flat rim, to at least partially separate outer ends of the flat rims.

6. The container described in claim 3 wherein: said ends of the flat rims separate after the join line is torn.

7. The container described in claim 1 wherein said container has a vertical axis, and wherein:

said base and lid have adjacent flat rims lying beside said join line and said join line has a pair of join line portions spaced apart along said join line where said lid and base are not joined;

said projection comprising a radially-projecting base tab that lies in said space between join line portions, said base tab projecting radially outward beyond said join line, to enable said base tab to be grasped to lift said base first side.

8. The container describes in claim 7 wherein: said lid has a cutout, and said radially-projecting base tab lies in said cutout when said base has been pivoted 180 degrees from a position wherein said lid is closed on said base.

9. A method for forming a container out of a plastic sheet wherein the container can be loaded with food by a clerk and then closed by the clerk, and the container thereafter resists initial opening by a customer, comprising:

forming a single plastic sheet into base and lid parts with adjacent first sides that are joined by a join line that merges with the base and lid and that is weakened to facilitate tearing along said join line;

forming at least one gap in said plastic sheet along said join line, to leave a plurality of joined, weakened locations where said first sides of said base and lid are joined and a tab on said lid or base extending beyond said joined, weakened locations; and after the forming step, pivoting and folding portions of said plastic sheet on opposite sides of said join line to bring said second sides of said base and lid together, and coupling said second sides so the second side of the lid resists its upward movement away from said base second side but said lid second side can pivot to allow said lid first side to pivot open above said base first side when said first side of said lid is lifted after tearing said plastic sheet along said join line.

10. The method of claim 9 wherein: said weakened portions do not separate the projection from the remainder of the base.

11. A container comprising a base and lid of plastic, the base and lid each having first and second sides and the second sides of the base and lid are latched together to inhibit initial opening thereat, said container forming an arrangement at said first side of the base and lid that requires an additional lift force on the lid to initially separate the lid first side from the base first side, but after the initial separation followed by closing of the lid it requires a lesser lift force to separate the lid first side from the base first side, wherein:

at said first side, said lid and base are joined by a fold line about which the lid and base can rotate relative to each other, said fold line including a weakened portion that is less resistant to tearing along said fold line than along the rest of the plastic sheeting, to facilitate tearing at said weakened portion;

at said first side of said lid and base, said base has a projection extending radially outward from said fold line.

12. The container described in claim 11 wherein: said base and lid each have adjacent flat rims lying beside said join line, and of the flat rims of said base and lid at least one of them has a bump that projects towards the other flat rim, to at least partially separate outer ends of the flat rims.

13. The container described in claim 11 wherein: said base second side has a downwardly-facing base shoulder and said lid second side has an upwardly-facing lid rim part that lies under said base shoulder, to prevent said lid second side from lifting unless said lid first side has been lifted off said base first side so said lid second side can be slid so it does not lie under said base shoulder.

* * * * *